US006744193B2

(12) United States Patent
Kim et al.

(10) Patent No.: US 6,744,193 B2
(45) Date of Patent: Jun. 1, 2004

(54) FUNNEL STRUCTURE FOR CATHODE RAY TUBE

(75) Inventors: Do-Hoon Kim, Daegu (KR); Hyeon-Soo Hong, Kyeongsangbuk-Do (KR)

(73) Assignee: LG Philips Displays Korea Co., Ltd., Kyeongsangbuk-Do (KR)

( * ) Notice: Subject to any disclaimer, the term of this patent is extended or adjusted under 35 U.S.C. 154(b) by 0 days.

(21) Appl. No.: 10/289,418

(22) Filed: Nov. 7, 2002

(65) Prior Publication Data

US 2003/0214219 A1 Nov. 20, 2003

(30) Foreign Application Priority Data

May 15, 2002 (KR) ..... 2002-26924

(51) Int. Cl.[7] ..... H01J 31/00
(52) U.S. Cl. ..... 313/477 R; 220/2.1 A
(58) Field of Search ..... 313/477 R, 440, 313/415, 477 AC, 461; 270/2.12, 2.32; 335/210, 213

(56) References Cited

U.S. PATENT DOCUMENTS 5,962,964 A 10/1999 Sano et al.
6,323,591 B1 * 11/2001 Oosterhout et al. ..... 313/477 R
6,396,204 B1 * 5/2002 Park et al. ..... 313/440
6,495,951 B1 * 12/2002 Kim et al. ..... 313/440
6,528,936 B1 * 3/2003 Lee et al. ..... 313/477 R
2003/0057822 A1 * 3/2003 Kim ..... 313/477 R
2003/0062819 A1 * 4/2003 Murakami ..... 313/477 R

* cited by examiner

*Primary Examiner*—Vip Patel
*Assistant Examiner*—Glenn Zimmerman
(74) *Attorney, Agent, or Firm*—Birch, Stewart, Kolasch & Birch, LLP

(57) ABSTRACT

A funnel structure for a cathode ray tube satisfies following equations $0.33 \leqq Rh_{maj}/Rh_{maj} \leqq 0.51$, $Rh_{maj}=H_{maj}/U_{maj}$, $R_{maj}=a_{maj}/b_{maj}$, wherein a length of a major axis evaluation line as an imaginary line connecting the major axis outer end of a sealing surface, at which a panel meets a funnel, with the major axis outer end of a TOR (top of round), at which a body portion meets a yoke portion, is defined as $b_{maj}$; a length from a point on the major axis evaluation line, which has a maximum vertical line length to the outer surface of the funnel, to the major axis outer end of the sealing surface is defined as $a_{maj}$; a maximum length of the vertical line is defined as $H_{maj}$; and ½ of a major axis length of an effective surface of the panel is defined as $U_{maj}$.

16 Claims, 4 Drawing Sheets

FUNNEL STRUCTURE FOR CATHODE RAY TUBE

This nonprovisional application claims priority under 35 U.S.C. §119(a) on Patent Application No. 2002-0026924 filed in Korea on May 15, 2002, which is herein incorporated by reference.

BACKGROUND OF THE INVENTION

1. Field of the Invention

The present invention relates to a cathode ray tube, and in particular to a funnel structure for a cathode ray tube which is capable of preventing breakage by stress concentration.

2. Description of the Prior Art

In general, a cathode ray tube materializes an optical screen by converting an electric signal into an electron beam and emitting the electron beam onto a fluorescent surface. Because the cathode ray tube has excellent display quality in contradiction to a price, it is widely used.

The cathode ray tube will be described in detail with reference to accompanying drawings.

FIG. 1 is a longitudinal-sectional view illustrating a general cathode ray tube.

In the general cathode ray tube, a front glass as a panel 1 is combined with a rear glass as a funnel 5, and it is sealed in a high vacuum state.

And, the cathode ray tube includes a fluorescent surface 3 coated onto the internal surface of the panel 1 and performing a certain luminescent material function; an electron gun 13 emitting an electron beam 14 for making the fluorescent surface 3 fluoresce; a deflection yoke 10 installed at the outer circumference of the funnel 5 and deflecting the electron beam 14 so as to be scanned appropriate to an area of the fluorescent surface 3; a shadow mask 6 installed with a distance from the fluorescent surface 3; and a reinforcing band 15 installed at the side circumference of the panel 1 and dispersing stress occurred on the panel 1 and the funnel 5.

The panel 1 has a curved inner surface and a substantially flat outer surface.

The funnel 5 performs a vacuous body function with a certain space formed by being combined with the panel 1 and the electron gun 13 and fixedly supports the deflection yoke 10 and the electron gun 13.

The funnel 5 is largely divided into a body portion 51 at which the panel 1 is installed, a yoke portion 52 at which the deflection yoke 10 is installed and a neck portion 53 at which the electron gun 13 is installed.

Herein, a line of demarcation between the body portion 51 and the yoke portion 52 is called a TOR (top of round) 7, a line of demarcation between the yoke portion 52 and the neck portion 53 is called a neck seal 9, and an imaginary line as a base of the total length of the funnel 5 is called a reference line 8.

In addition, a portion at which the panel 1 and the funnel 5 are combined with each other is called a sealing surface 4, twice of an angle 18 of a cross point between a center axis 12 of the funnel 1 and the reference line 8 to an imaginary line connecting the cross point with an effective surface end 17 of the shadow mask 6 is called a deflection angle.

In the above-described cathode ray tube, because the cathode ray tube has a large width comparably, it is difficult to secure an installation space, in addition, it is heavy. In more detail, with a recent slim-lightweight trend in electronic equipment, in order to slim down the cathode ray tube, a method of reducing the total length of the panel 1 and a method of reducing the total length of the funnel 5 can be used.

Herein, when the total length of the panel 1 is reduced, by vacuuming after an exhaust process, high tensile stress is occurred on the sealing surface 4 at which the panel 1 and the funnel 5 are combined with each other. In addition, because a space for combining the reinforcing band 15 is reduced, stress dispersion efficiency of the reinforcing band 15 is lowered.

In the meantime, when the total length of the funnel 5 is reduced, relatively high stress occurs on the funnel 5 having a thickness smaller than that of the panel 1. In particular, because high tensile stress occurs on the sealing surface 4 at which the panel 1 and the funnel 5 are combined with each other, breakage may easily occur in production process.

Therefore, tensile stress in vacuum has to be thoroughly considered, in general, a limit stress value of the funnel 5 is not greater than 12 MPa in designing. In more detail, when stress value of the funnel 5 is not less than 12 MPa, a crack may occur even in a small impact, the stress may proceed the crack, and accordingly implosion of the funnel 5 may occur.

In the meantime, in order to reduce the stress concentration, a thickness of the body portion 51 of the funnel 5 can be increased, in that case, a thickness difference between the yoke portion 52 and the body portion 51 is increased, in a temperature lowering process in fabrication of the funnel 5, a crack may occur by a heat capacity difference due to the thickness difference between the body portion 51 and the yoke portion 52.

In addition, when the thickness of the yoke portion 52 is increased inwardly, a BSN (beam shadow neck) in which the electron beam 14 is covered by interference of the internal surface of the yoke portion 52 occurs, a screen quality of the cathode ray tube is lowered.

Therefore, in lowering the stress concentration according to the sliming-down of the funnel 5, the method of increasing the thickness of the funnel 5 is not preferable. Instead, it is most preferable to use a method of optimizing a shape of the funnel 5.

Accordingly, in order to optimize a shape of the funnel 5, a shape of the funnel 5 will be described with reference to FIGS. 2A and 2B.

FIGS. 2A and 2B illustrate a stress occurred around the TOR (top of round) 7 at which the sealing surface, the body portion 51 and the yoke portion 52 of the yoke portion 52 meet, before anything else, principal factors in determining a funnel shape will be described.

In more detail, a length of an evaluation line 21 connecting the outer end of the sealing surface 4 at which the panel 1 meets the funnel 5 with the outer end of the TOR 7 at which the body portion 52 meet the yoke portion 52 is defined as b. A length from a point on the evaluation line 21, which meets a vertical line 22 having a maximum length from the outer surface of the funnel 5 to the evaluation line 21, to the outer end of the sealing surface 4 is defined as a. And, a maximum length of the vertical line 22 is defined as H.

As depicted in FIG. 2A, in the funnel shape such as FIG. 2 (hereinafter, it is referred to as A type), because an a value and a H value was relatively small, stress around the yoke portion 52 of the funnel 5 was dispersed.

However, in the A type, in the vacuum state after combining the funnel 5 with the panel 1, stress concentration not less than 12 MPa occurred on the sealing surface 4.

In more detail, in the A type funnel, as depicted in FIG. 2A, when a maximum stress on a funnel minor axis was measured, a maximum stress around the yoke portion 52 was 6.3 MPa, however, a maximum stress on the sealing surface 4 was 15.3 MPa.

In the meantime, as depicted in FIG. 2B, in the funnel shape such as FIG. 2B (hereinafter, it is referred to as B type), because an a value and a H value were relatively big, stress around the sealing surface 4 of the funnel 5 was dispersed.

However, in the B type, stress concentration not less than 12 MPa occurred around the TOR 7 at which the body portion 51 met the yoke portion 52.

In more detail, in the B type funnel shape, as depicted in FIG. 2B, when a maximum stress of the funnel minor axis was measured, a maximum stress on the central portion of the sealing surface was 11.5 MPa, however, a maximum stress around the yoke portion was 21.1 MPa.

The stress concentration occurred in the A type and B type funnels may cause breakage with crack in fabrication of the cathode ray tube, and accordingly an yield rate may be lowered.

Accordingly, it is required to research a measure which is capable of lowering stress concentration and securing impact resistance of the funnel by grasping stress dispersion tendency according to the funnel shape.

SUMMARY OF THE INVENTION

In order to solve the above-mentioned problem, in order to lower stress concentration occurred according to sliming-down of a funnel, it is an object of the present invention to provide a funnel structure for a cathode ray tube which is capable of reducing cracked inferior products in fabrication and improving an yield rate by changing a shape of a funnel without increasing a thickness thereof.

In order to achieve the above-mentioned object, in a cathode ray tube including a panel having a fluorescent surface coated onto the internal surface and a funnel comprising of a body portion connected to the panel, a yoke portion at which a deflection yoke is installed and a neck portion at which an electron gun is installed, a funnel structure for a cathode ray tube satisfies following equations $0.33 \leqq Rh_{maj}/R_{maj} \leqq 0.51$, $Rh_{maj}=H_{maj}/U_{maj}$, $R_{maj}=a_{maj}/b_{maj}$, wherein a length of a major axis evaluation line as an imaginary line connecting the major axis outer end of a sealing surface, at which a panel meets a funnel, with the major axis outer end of a TOR (top of round), at which a body portion meets a yoke portion, is defined as $b_{maj}$; a length from a point on the major axis evaluation line, which has a maximum vertical line length to the outer surface of the funnel, to the major axis outer end of the sealing surface is defined as $a_{maj}$; a maximum length of the vertical line is defined as $H_{maj}$; and ½ of a major axis length of an effective surface of the panel is defined as $U_{maj}$.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, the preferred embodiment the present invention will be described with reference to accompanying drawings.

In the present invention, for an optimum shape design of a funnel for a cathode ray tube, principal factors are defined as below.

Figure 1:
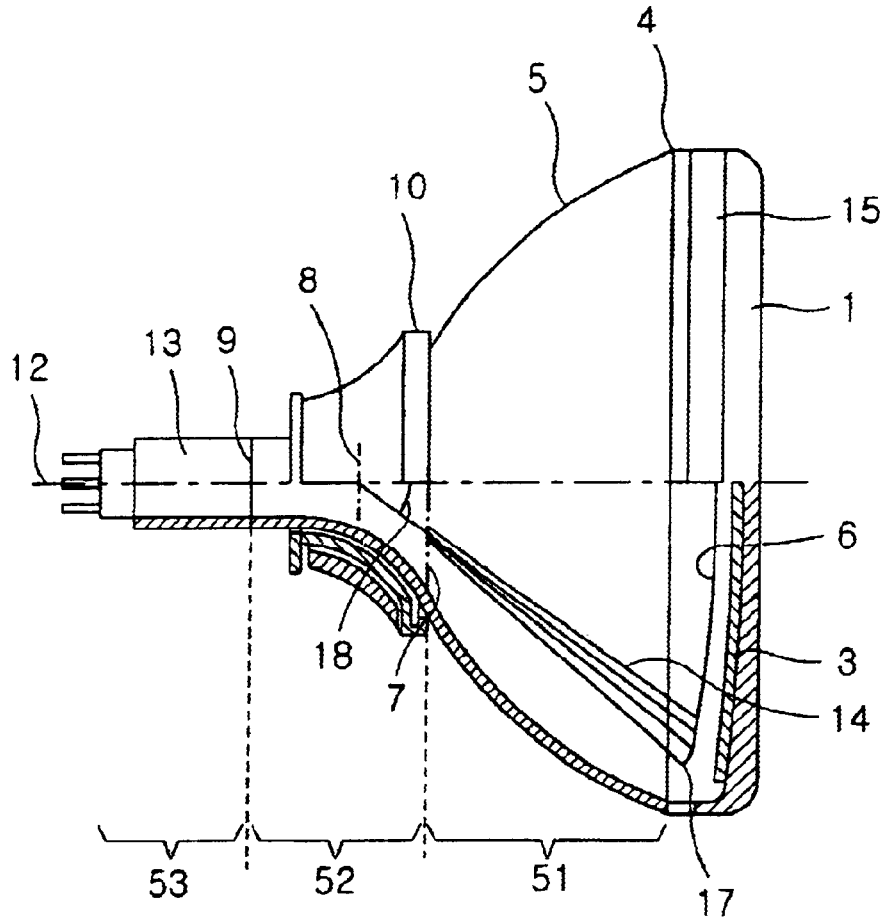
FIG. 1 CONVENTIONAL ART
FIG. 1 is a longitudinal-sectional view illustrating a general cathode ray tube.
Figure 2A:
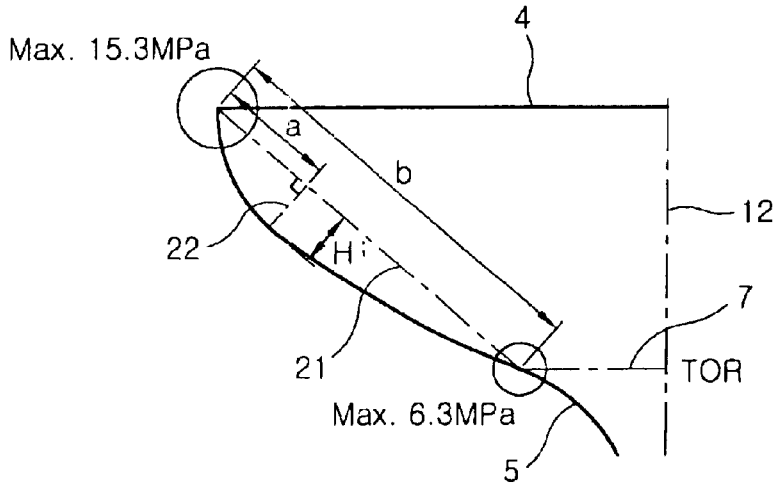
FIG. 2A CONVENTIONAL ART
FIGS. 2A and 2B are schematic view illustrating a funnel shape of a cathode ray tube and a stress value according to it.
Figure 2B:
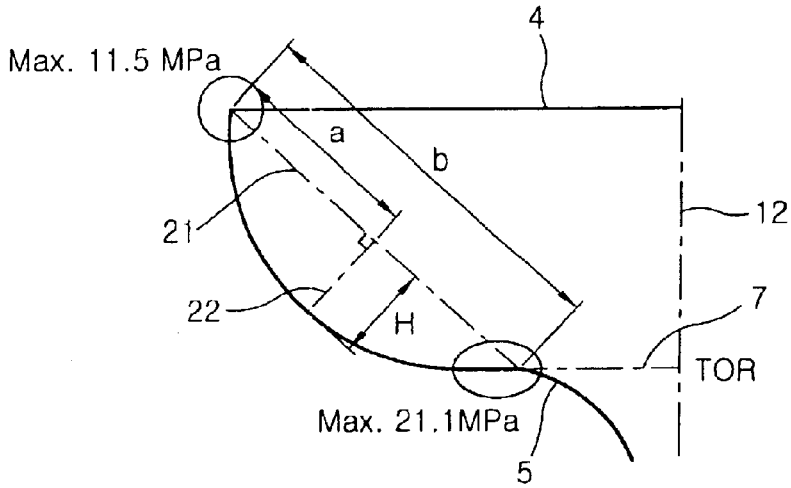
FIG. 2B CONVENTIONAL ART
Figure 3A:
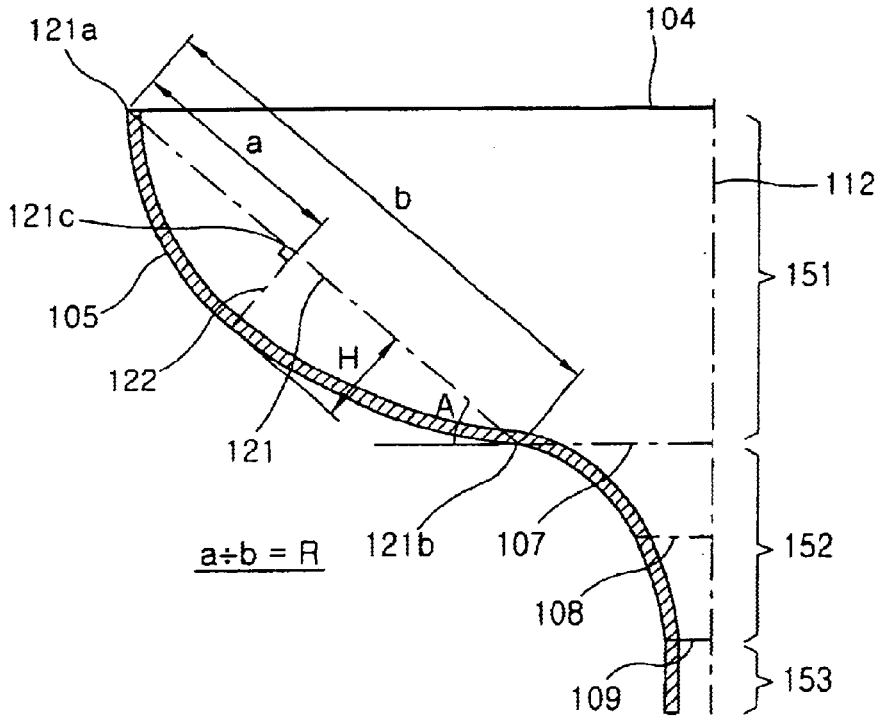
FIG. 3A is a schematic view for defining design elements of a funnel shape of a cathode ray tube in accordance with the present invention.

FIG. 3A is a schematic view for defining design elements of a funnel shape of a cathode ray tube in accordance with the present invention.

Figure 3B:
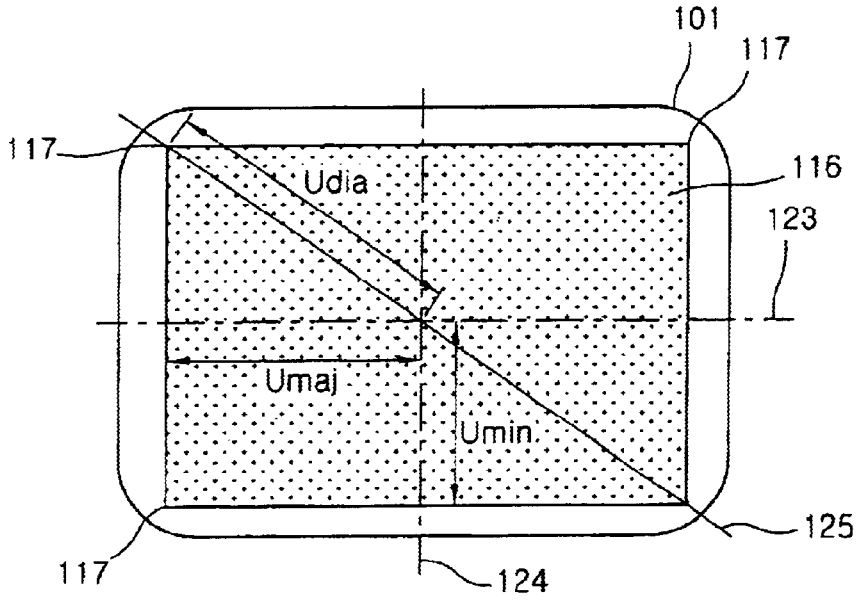
FIG. 3B is a schematic view for defining a length of a panel effective surface of a cathode ray tube in accordance with the present invention.

FIG. 3B is a schematic view for defining a length of a panel effective surface of a cathode ray tube in accordance with the present invention.

As depicted in FIGS. 3A and 3B, in the cathode ray tube, a funnel 105 is largely divided into a body portion 151 at which a panel 101 is installed, a yoke portion 152 at which a deflection yoke is installed and a neck portion 153 at which an electron gun is installed.

Herein, a line of demarcation between the body portion 151 and the yoke portion 152 is called a TOR (top of round) 107, a line of demarcation between the yoke portion 152 and the neck portion 153 is called a neck seal 109, and an imaginary line as a base of the total length of the funnel 101 is called a reference line 108.

And, as depicted in FIG. 3A, a length of an evaluation line 121 connecting the outer end 121*a* of the sealing surface 104 at which the panel 101 meets the funnel 105 with the outer end 121*b* of the TOR 107 at which the body portion 151 meet the yoke portion 152 is defined as b. A length from a point 121*c* on the evaluation line 121, which meets a vertical line 122 having a maximum length from the outer surface of the funnel 105 to the evaluation line 121, to the outer,end 121*a* of the sealing surface 104 is defined as a. A maximum length of the vertical line 122 is defined as H. And, an acute angle between the evaluation line 121 and the TOR 107 is defined as A. Herein, an a/b value is defined as R.

And, as depicted in FIG. 3B, in the panel 101, a region coated with the fluorescent surface and materializing the actual screen is an effective surface 116, on the basis of a central axis 112 of the funnel 105, a distance from the basis to the end of a major axis 123 is $U_{maj}$, a distance from the basis to the end of a minor axis 124 is $U_{min}$, a distance from the basis to the end of a diagonal axis 125 is $U_{dia}$. Herein, a H/U value is defined as Rh. Herein, the panel 101 has the plane outer surface, and the internal surface thereof has a certain shape.

Accordingly, by designing the funnel 105 so as to have an optimum shape by adjusting design element measures, high stress acting on the sealing surface 104 and the TOP 107 can be lowered, by measuring a maximum stress acting on the funnel 105 while varying the R and the Rh, an optimum design value which makes possible the funnel have a maximum stress not greater than 12 MPa can be obtained.

Following Tables 1~3 show several measures for describing effects according to the funnel shape variation.

In more detail, in the exhausting process of the cathode ray tube, with reference to variation of the major axis 123, the minor axis 124, the diagonal axis 125 and a Rh/R value of the funnel 105, Tables 1~3 respectively show a maximum stress acting on the A and B type funnels in accordance with the conventional art and a maximum stress acting on a C, a D and an E type funnels in accordance with the present invention.

Herein, a deflection angle of the electron beam is not less than 100°, an effective surface(screen) of the panel is about 16:9.

TABLE 1

| MAJOR | CONVENTIONAL ART | | PRESENT INVENTION | | |
|---|---|---|---|---|---|
| AXIS | TYPE A | TYPE B | TYPE C | TYPE D | TYPE E |
| a (mm) | 92.19 | 83.7 | 90.79 | 73.07 | 97.85 |
| b (mm) | 295.29 | 295.47 | 294.59 | 300.33 | 296.52 |
| R | 0.31 | 0.28 | 0.31 | 0.24 | 0.33 |
| H (mm) | 31.03 | 50.56 | 36.45 | 40.78 | 36.45 |
| U (mm) | 331.20 | 331.20 | 331.20 | 331.20 | 331.20 |
| Rh | 0.09 | 0.15 | 0.11 | 0.12 | 0.11 |
| Rh/R | 0.30 | 0.54 | 0.36 | 0.51 | 0.33 |
| Maximum Stress (MPa) | 13.30 | 17.10 | 11.74 | 11.85 | 11.91 |

In Table 1, values of the minor axis 124 and the diagonal axis 125 of the funnel 101 are the same and a shape of the major axis 123 of the funnel 101 is varied in several types, and a maximum stress value occurred in each type is shown.

Figure 4:
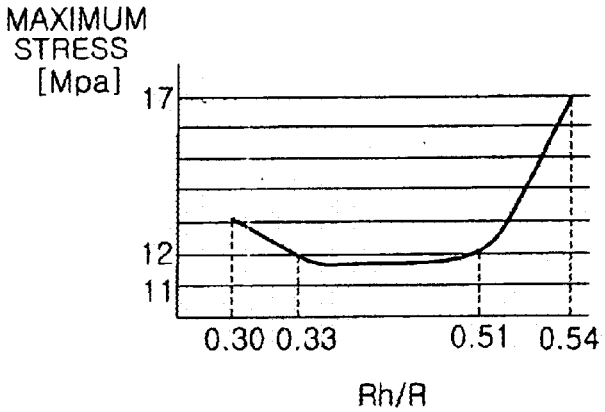
FIG. 4 is a graph illustrating a maximum stress variation on a funnel about a funnel major axis Rh/R value variation of the cathode ray tube in accordance with the present invention.

In addition, maximum stress variation characteristics about Rh/R value variation of each type in Table 1 are described in FIG. 4.

As shown in Table 1, in the conventional A and B type funnel shapes, a maximum stress over 12 MPa as the limit design stress of the funnel occurs, however, in the C, D and E type funnel shapes in accordance with the present invention, a stable stress value below 12 MPa as the limit design stress of the funnel glass occurs.

In more detail, as depicted in FIG. 4, when a Rh/R value of the funnel major axis 123 is in the range of 0.33~0.51, a maximum stress acting on the funnel is not greater than 12 MPa.

Accordingly, it is preferable for a Rh/R value of the funnel major axis 123 to be within the range of 0.33~0.51.

TABLE 2

| MINOR | CONVENTIONAL ART | | PRESENT INVENTION | | |
|---|---|---|---|---|---|
| AXIS | TYPE A | TYPE B | TYPE C | TYPE D | TYPE E |
| a (mm) | 70.26 | 73.33 | 65.59 | 89.63 | 67.53 |
| b (mm) | 200.52 | 200.52 | 200.52 | 195.01 | 198.62 |
| R | 0.35 | 0.37 | 0.38 | 0.46 | 0.34 |
| H (mm) | 22.08 | 35.40 | 29.87 | 41.43 | 26.08 |
| U (mm) | 186.30 | 186.30 | 186.30 | 186.30 | 186.30 |
| Rh | 0.12 | 0.19 | 0.16 | 0.22 | 0.14 |

TABLE 2-continued

| MINOR | CONVENTIONAL ART | | PRESENT INVENTION | | |
|---|---|---|---|---|---|
| AXIS | TYPE A | TYPE B | TYPE C | TYPE D | TYPE E |
| Rh/R | 0.34 | 0.51 | 0.50 | 0.48 | 0.41 |
| Maximum Stress (MPa) | 14.30 | 12.10 | 11.50 | 11.70 | 11.98 |

In Table 2, values of the major axis 123 and the diagonal axis 125 of the funnel 101 are the same and a shape of the minor axis 124 of the funnel 101 is varied in several types, and a maximum stress value occurred in each type is shown.

Figure 5:
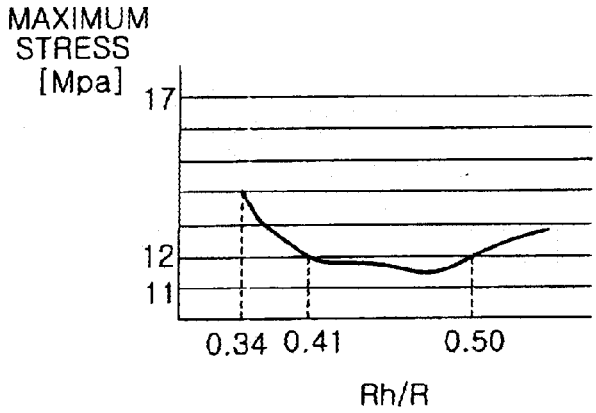
FIG. 5 is a graph illustrating a maximum stress variation on a funnel about a funnel minor axis Rh/R value variation of the cathode ray tube in accordance with the present invention.

In addition, maximum stress variation characteristics about Rh/R value variation of each type in Table 2 are described in FIG. 5.

As shown in Table 2, in the conventional A and B type funnel shapes, a maximum stress over 12 MPa as the limit design stress of the funnel occurs, however, in the C, D and E type-funnel shapes in accordance with the present invention, a stable stress value below 12 MPa as the limit design stress of the funnel glass occurs.

In more detail, as depicted in FIG. 5, when a Rh/R value of the funnel minor axis 124 is in the range of 0.41~0.50, a maximum stress acting on the funnel is not greater than 12 MPa.

Accordingly, it is preferable for a Rh/R value of the funnel minor axis 124 to be within the range of 0.41~0.50.

TABLE 3

| DIAGONAL | CONVENTIONAL ART | | PRESENT INVENTION | | |
|---|---|---|---|---|---|
| AXIS | TYPE A | TYPE B | TYPE C | TYPE D | TYPE E |
| a (mm) | 137.17 | 85.83 | 87.13 | 129.94 | 84.35 |
| b (mm) | 334.56 | 330.74 | 330.74 | 336.04 | 330.74 |
| R | 0.41 | 0.26 | 0.26 | 0.39 | 0.26 |
| H (mm) | 30.40 | 52.72 | 34.63 | 33.50 | 29.39 |
| U (mm) | 380.00 | 380.00 | 380.00 | 380.00 | 380.00 |
| Rh | 0.08 | 0.14 | 0.09 | 0.09 | 0.08 |
| Rh/R | 0.20 | 0.53 | 0.35 | 0.23 | 0.30 |
| Maximum Stress (MPa) | 13.25 | over 12 | 11.70 | 11.91 | 11.53 |

In Table 3, values of the major axis 123 and the minor axis 124 of the funnel 101 are the same and a shape of the diagonal axis 125 of the funnel 101 is varied in several types, a maximum stress value occurred in each type is shown.

Figure 6:
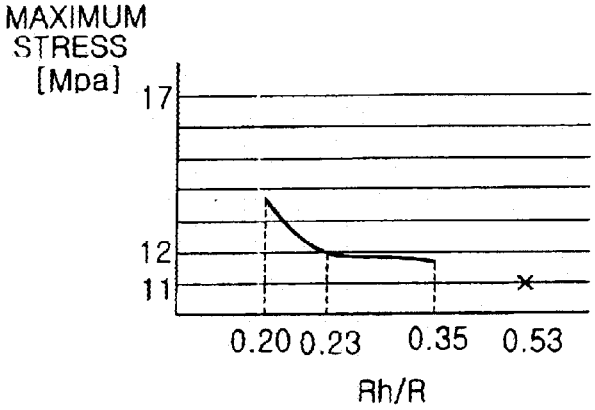
FIG. 6 is a graph illustrating a maximum stress variation of a funnel about a funnel diagonal axis Rh/R value variation of the cathode ray tube in accordance with the present invention.

In addition, maximum stress variation characteristics about Rh/R value variation of each type in Table 3 are described in FIG. 6.

As shown in Table 3, in the conventional A and B type funnel shapes, a maximum stress over 12 MPa as the limit design stress of the funnel occurs, however, in the C, D and E type funnel shapes in accordance with the present invention, a stable stress value below 12 MPa as the limit design stress of the funnel glass occurs.

In more detail, as depicted in FIG. 6, when a Rh/R value of the funnel diagonal axis 125 is in the range of 0.23~0.35, a maximum stress acting on the funnel is not greater than 12 MPa.

Accordingly, it is preferable for a Rh/R value of the funnel diagonal axis 125 to be within the range of 0.23~0.35.

When shapes of the major axis 123 and the minor axis 124 of the funnel 105 about the central axis 112 of the funnel 105 are determined, a shape of the diagonal axis 125 is limited.

In the funnel for the cathode ray tube in accordance with the present invention, when the shapes of the major axis, the minor axis and the diagonal axis are applied to a slim type cathode ray tube, it is possible to lower stress concentration occurred on the funnel by only varying a shape of the funnel without increasing a thickness hereof, and accordingly an inferior goods rate can be remarkably reduced and an yield rate can be improved.

Advantages in use of the funnel structure for the cathode ray tube in accordance with the present invention will be described with reference to following Table 4.

TABLE 4

| | Sample | crack | implosion |
|---|---|---|---|
| Conventional art | 50 | 8 | 6 |
| Present invention | 50 | 0 | 0 |

In more detail, as depicted in Table 4, in test results obtained by crashing an iron bead having a certain amount of energy with the funnel according to explosion proof test standards in order to grasp a degree of crack, the funnel for the cathode ray tube in accordance with the present invention shows lower crack occurrence, and accordingly implosion by crack can be reduced.

The funnel structure for the cathode ray tube in accordance with the present invention can reduce stress concentration occurred in sliming-down of the cathode ray tube by only changing a shape of the funnel without increasing a thickness thereof, an inferior goods rate can be remarkably reduced and an yield rate can be improved in a heat process of the cathode ray tube.

What is claimed is:

1. In a cathode ray tube including a panel having a fluorescent surface coated onto the internal surface and a funnel comprising of a body portion connected to the panel, a yoke portion at which a deflection yoke is installed and a neck portion at which an electron gun is installed, a funnel structure for a cathode ray tube satisfies the equations $$0.33 \leq Rh_{maj}/R_{maj} \leq 0.51$$

and $$Rh_{maj}=H_{maj}/U_{maj},\ R_{maj}=a_{maj}/b_{maj}$$

wherein a length of a major axis evaluation line as an imaginary line connecting the major axis outer end of a sealing surface, at which a panel meets a funnel, with the major axis outer end of a TOR (top of round), at which a body portion meets a yoke portion, is defined as $b_{maj}$; a length from a point on the major axis evaluation line, which has a maximum vertical line length to the outer surface of the funnel, to the major axis outer end of the sealing surface is defined as $a_{maj}$; a maximum length of the vertical line is defined as $H_{maj}$; and ½ of a major axis length of an effective surface of the panel is defined as $U_{maj}$.

2. The funnel structure of claim 1, wherein the funnel structure for the cathode ray tube satisfies the equations $$0.41 \leq Rh_{min}/R_{min} \leq 0.50$$

and $$Rh_{min}=H_{min}/U_{min},\ R_{min}=a_{min}/b_{min}$$

wherein a length of a minor axis evaluation line as an imaginary line connecting the minor axis outer end of a sealing surface, at which a panel meets a funnel, with the minor axis outer end of a TOR (top of round), at which a body portion meets a yoke portion, is defined as $b_{min}$; a length from a point on the minor axis evaluation line, which has a maximum vertical line length to the outer surface of the funnel, to the minor axis outer end of the sealing surface is defined as $a_{min}$; a maximum length of the vertical line is defined as $H_{min}$; and ½ of a minor axis length of an effective surface of the panel is defined as $U_{min}$.

3. The funnel structure of claim 2, wherein the funnel structure for the cathode ray tube satisfies the equation $$0.23 \leq Rh_{dia}/R_{dia} 0.35$$

wherein a length of a diagonal axis evaluation line as an imaginary line connecting the diagonal axis outer end of a sealing surface, at which a panel meets a funnel, with the diagonal axis outer end of a TOR (top of round), at which a body portion meets a yoke portion, is defined as $b_{dia}$; a length from a point on the diagonal axis evaluation line, which has a maximum vertical line length to the outer surface of the funnel, to the diagonal axis outer end of the sealing surface is defined as $a_{dia}$; a maximum length of the vertical line is defined as $H_{dia}$; and ½ of a diagonal axis length of an effective surface of the panel is defined as $U_{dia}$.

4. The funnel structure of claim 1, wherein the funnel structure for the cathode ray tube satisfies the equation $$0.23 \leq Rh_{dia}/R_{dia} \leq 0.35$$

wherein a length of a diagonal axis evaluation line as an imaginary line connecting the diagonal axis outer end of a sealing surface, at which a panel meets a funnel, with the diagonal axis outer end of a TOR (top of round), at which a body portion meets a yoke portion, is defined as $b_{dia}$; a length from a point on the diagonal axis evaluation line, which has a maximum vertical line length to the outer surface of the funnel, to the diagonal axis outer end of the sealing surface is defined as $a_{dia}$; a maximum length of the vertical line is defined as $H_{dia}$; and ½ of a diagonal axis length of an effective surface of the panel is defined as $U_{dia}$.

5. The funnel structure of claim 1, wherein the panel has a curved inner surface and a substantially flat outer surface.

6. The funnel structure of claim 1, wherein a ratio of width to height in the effective surface of the panel is about 16:9.

7. The funnel structure of claim 1, wherein the deflection yoke has a deflection angle not less than 100°.

8. In a cathode ray tube including a panel having a fluorescent surface coated onto the internal surface and a funnel comprising of a body portion connected to the panel, a yoke portion at which a deflection yoke is installed and a neck portion at which an electron gun is installed, a funnel structure for a cathode ray tube satisfies the equations $$0.41 \leq Rh_{min}/R_{min} \leq 0.50$$

and $$Rh_{min}=H_{min}/U_{min},\ R_{min}=a_{min}/\ b_{min}$$

wherein a length of a minor axis evaluation line as an imaginary line connecting the minor axis outer end of a sealing surface, at which a panel meets a funnel, with the minor axis outer end of a TOR (top of round), at which a body portion meets a yoke portion, is defined as $b_{min}$; a length from a point on the minor axis evaluation line, which has a maximum vertical line length to the outer surface of the funnel, to the minor axis outer end of the sealing surface is defined as $a_{min}$; a maximum length of the vertical line is defined as $H_{min}$; and ½ of a minor axis length of an effective surface of the panel is defined as $U_{min}$.

9. The funnel structure of claim 8, wherein the funnel structure for the cathode ray tube satisfies the equation $$0.23 \leqq Rh_{dia}/R_{dia} \leqq 0.35$$

wherein a length of a diagonal axis evaluation line as an imaginary line connecting the diagonal axis outer end of a sealing surface, at which a panel meets a funnel, with the diagonal axis outer end of a TOR (top of round), at which a body portion meets a yoke portion, is defined as $b_{dia}$; a length from a point on the diagonal axis evaluation line, which has a maximum vertical line length to the outer surface of the funnel, to the diagonal axis outer end of the sealing surface is defined as $a_{dia}$; a maximum length of the vertical line is defined as $H_{dia}$; and ½ of a diagonal axis length of an effective surface of the panel is defined as $U_{dia}$.

10. The funnel structure of claim 8, wherein the panel has a curved inner surface and a substantially flat outer surface.

11. The funnel structure of claim 8, wherein a ratio of width to height in the effective surface of the panel is about 16:9.

12. The funnel structure of claim 8, wherein the deflection yoke has a deflection angle not less than 100°.

13. In a cathode ray tube including a panel having a fluorescent surface coated onto the internal surface and a funnel comprising of a body portion connected to the panel, a yoke portion at which a deflection yoke is installed and a neck portion at which an electron gun is installed, a funnel structure for a cathode ray tube satisfies the equations $$0.23 \leqq Rh_{dia}/R_{dia} \leqq 0.35$$

and $$Rh_{dia}=H_{dia}/U_{dia},\ R_{dia}=a_{dia}/b_{dia}$$

wherein a length of a diagonal axis evaluation line as an imaginary line connecting the diagonal axis outer end of a sealing surface, at which a panel meets a funnel, with the diagonal axis outer end of a TOR (top of round), at which a body portion meets a yoke portion, is defined as $b_{dia}$; a length from a point on the diagonal axis evaluation line, which has a maximum vertical line length to the outer surface of the funnel, to the diagonal axis outer end of the sealing surface is defined as $a_{dia}$; a maximum length of the vertical line is defined as $H_{dia}$; and ½ of a diagonal axis length of an effective surface of the panel is defined as $U_{dia}$.

14. The funnel structure of claim 13, wherein the panel has a curved inner surface and a substantially flat outer surface.

15. The funnel structure of claim 13, wherein a ratio of width to height in the effective surface of the panel is about 16:9.

16. The funnel structure of claim 13, wherein the deflection yoke has a deflection angle not less than 100°.

* * * * *